US008646426B2

(12) United States Patent
Finkenbiner

(10) Patent No.: US 8,646,426 B2
(45) Date of Patent: Feb. 11, 2014

(54) VALVE LASH SETTING PROCESS

(75) Inventor: Mark Allen Finkenbiner, Conway, SC (US)

(73) Assignee: Atlas Copco Tools & Assemble Systems LLC, Auburn Hills, MI (US)

( * ) Notice: Subject to any disclaimer, the term of this patent is extended or adjusted under 35 U.S.C. 154(b) by 665 days.

(21) Appl. No.: 12/880,503

(22) Filed: Sep. 13, 2010

(65) Prior Publication Data

US 2011/0061621 A1 Mar. 17, 2011

Related U.S. Application Data

(60) Provisional application No. 61/242,036, filed on Sep. 14, 2009.

(51) Int. Cl.
*F01L 1/18* (2006.01)

(52) U.S. Cl.
USPC ..... 123/90.43; 123/90.45; 123/90.52; 73/119 R; 81/9.24

(58) Field of Classification Search
USPC ..... 123/90.43, 90.45, 90.52; 73/119 R; 81/9.24
See application file for complete search history.

(56) References Cited

U.S. PATENT DOCUMENTS 6,205,850 B1 * 3/2001 Wehrman et al. ..... 73/114.79
6,474,283 B1 11/2002 Gidlund

* cited by examiner

*Primary Examiner* — Ching Chang
(74) *Attorney, Agent, or Firm* — Young Basile Hanlon & MacFarlane P.C.

(57) ABSTRACT

A valve lash setting method for setting a predetermined lash in a valve assembly for internal combustion engines. The method includes generating a torque curve and using a linear regression calculation to define a zero crossing point from which a predetermined final lash position of an adjusting screw can be set and secured.

18 Claims, 9 Drawing Sheets

| Step # | Adjuster Process Inner Spindle | | Lock Nut Process Outer Spindle | |
|---|---|---|---|---|
| 1 | 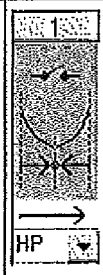 | HP (Hold Position): The Hold Position function will maintain the spindles current position while the outer spindle performs its function. Hold Position will stop when the outer spindle completes its function. | TRT (Transport to Torque): The use of the TRT step provides the functionality of engaging the lock nut to the lock nut spindle. Generally torque required is 5 – 10 Nm. This ensures by positive feedback of torque that the locknut is engaged and ready. | 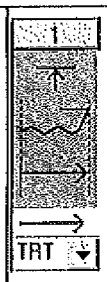 |
| 2 | 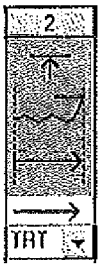 | TRT (Transport to Torque): The use of the TRT step provides the functionality of engaging the adjuster screw to the inner spindle. Generally torque required is 1 - 2 Nm. This ensures by positive feedback of torque that the inner spindle is engaged and ready. | HP (Hold Position): The Hold Position function will maintain the spindles current position while the inner spindle performs its function. Hold Position will stop when the inner spindle completes its function. | 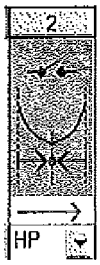 |
| 3 | 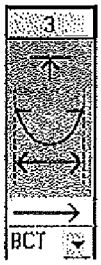 | BCT (Back Lash Measure): The backlash measurement step is required to measure the lash in the drive train, including the bit in the adjusting screw, of the inner spindle. The measurement and removal of the backlash is important in the setting process because the positional control is required to set the final lash position. The lock nut must be tight to correctly measure the back lash. | HP (Hold Position): The Hold Position function will maintain the spindles current position while the inner spindle performs its function. Hold Position will stop when the inner spindle completes its function. | 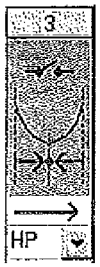 |
| 4 | 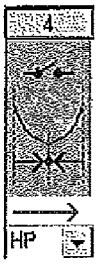 | HP (Hold Position): The Hold Position function will maintain the spindles current position while the outer spindle performs its function. Hold Position will stop when the outer spindle completes its function. | TRA (Transport by Angle): This step is used to rotate the lock nut CCW to loosen the clamploaded developed on the adjuster screw. Once loose the process of setting the valve lash can begin. Generally set to $180^0 - 360^0$. | 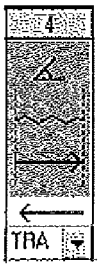 |

FIG. 4

| | | | | |
|---|---|---|---|---|
| 5 | 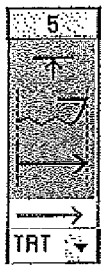 | TRT (Transport to Torque): The transport to torque function is used here to run down the adjuster screw to force the rocker arm to contact the spring body. Upon contact of the two components a torque is generated with a linear slope rate. This slope rate is measured and a regression is performed to calculate the "zero crossing" point as a reference (Final Position) to be used in the valve lash set position. | HP (Hold Position): The Hold Position function will maintain the spindles current position while the corresponding spindle performs its function. Hold Position will stop when the inner spindle completes its function. | 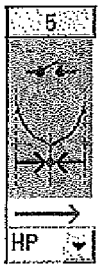 |
| 6 | 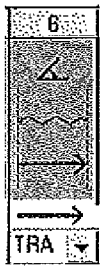 | TRA (Transport by Angle): The transport by angle step is used to error proof the setting process. The spindle continues to rotate in the CW direction creating a continuation of torque. If the torque is present and maintains a measured value then the slope that the final position was calculated from was valid and the valve lash set will be acceptable. | HP (Hold Position): The Hold Position function will maintain the spindles current position while the corresponding spindle performs its function. Hold Position will stop when the inner spindle completes its function. | 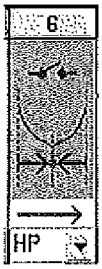 |
| 7 | 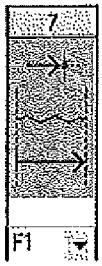 | F1 (Final Position) This step returns the inner spindle to the home position flag of the TRT step's zero crossing regression. Within the steps programming we set it to stop "x" degrees from final position. The x degree is calculated by thread pitch and rocker arm lever distance. Upon calculation of these values the spindle will set the specific valve lash based on the slope calculation of the TRT step. | HP (Hold Position): The Hold Position function will maintain the spindles current position while the corresponding spindle performs its function. Hold Position will stop when the inner spindle completes its function. | 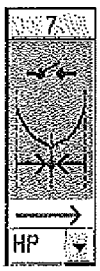 |

FIG. 5

| | | | | |
|---|---|---|---|---|
| 8 | 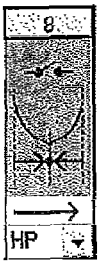 | HP (Hold Position): The Hold Position function will maintain the spindles current position while the outer spindle performs its function. Hold Position will stop when the outer spindle completes its function. | TRT (Transport to Torque): The use of the TRT step provides the functionality of running down the lock nut to the lock nut spindle to a seating torque. Generally torque required is 5 – 10 Nm. | 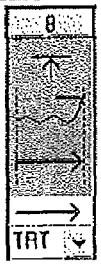 |
| 9 | 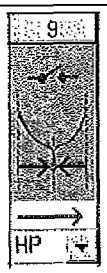 | HP (Hold Position): The Hold Position function will maintain the spindles current position while the outer spindle performs its function. Hold Position will stop when the outer spindle completes its function. | TRT (Transport to Torque): The use of the TRT step provides the functionality of running down the lock nut to the lock nut spindle to a Final torque. Final Torque is specified by the manufacturer. | 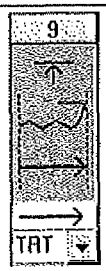 |
| 10 | 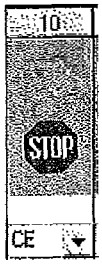 | CE (Cycle End): Cycle End step synchronizes the ending of the dual programs functionality of setting Valve Lash. | CE (Cycle End): Cycle End step synchronizes the ending of the dual programs functionality of setting Valve Lash. | 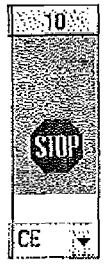 |

FIG. 6

VALVE LASH SETTING PROCESS

CROSS-REFERENCE TO RELATE APPLICATIONS

This invention claims priority to Provisional Patent Application Ser. No. 61/242,036 filed on Sep. 14, 2009 and is incorporated herein by reference in its entirety.

BACKGROUND OF THE INVENTION

Accurate adjustment of a clearance between internal combustion engine intake, exhaust, and other valves is important if maximum engine performance and economy are to be obtained. This clearance may also be referred to as "valve lash". Measuring, adjusting and controlling of valve lash is important to take into account the inherent tolerances and variations in the initial manufacture and assembly of the many mechanical engine components and throughout the life of the engine. Failure to accurately measure valve lash and make necessary adjustments thereto may result in gradual degradation of engine performance and reduced fuel combustion efficiency. Engine manufacturers typically have specific requirements for setting valve lash. For example, an engine manufacturer may specify that an intake valve lash should be set to 0.3 to 0.5 mm, that an exhaust valve be set to 0.6 to 0.8 mm, or that a Jake Brake valve be set to 0.8 to 1.2 mm.

In prior processes, valve lash may be initially set by a worker manually screwing in or backing out an adjuster screw that contacts the spring structure that moves a valve. The worker would manually tighten or loosen the adjuster screw while measuring the valve lash using, for example, feeler gauges. After the worker has manually adjusted the adjuster screw such that the valve lash is within the manufacturer's specified range, the worker must hold the adjuster screw stationary while tightening a lock nut. This process can be problematic for various reasons. For example, measurements taken with feeler gauges are often inaccurate due to inconsistent feeler gauge use from measurement to measurement, especially between different workers. As another example, if the adjuster screw is inadvertently allowed to move while tightening the lock nut, the lash setting can change defeating the principal objective of the process.

As an alternative to manually measuring valve lash, valve lash can be set by a processes using an automated tool. For example, in one such process, an adjuster screw torque at which a valve is set to a zero lash position can be determined experimentally by performing repeated measurements of one or more test engines of a certain type. Then, when setting the valve lash on an engine of the same type, the valve lash can be initially set such that the experimentally determined adjuster screw torque is achieved, and the valve can be assumed to be set at the zero lash position at the experimentally determined torque. From the zero lash position, the adjuster screw can be turned a known amount based on a pitch of the adjuster screw in order to obtain the specified valve lash setting.

These prior processes although useful, were imprecise, time and labor intensive and only slightly improved on reducing or minimizing the many variations and tolerance stack-ups inherent in the complex mechanical engine system. These prior lash setting processes relied on empirically derived averages to estimate a zero crossing point or zero lash point of a particular valve assembly which is a necessary starting point to set a predetermined or specified lash distance or setting for optimal operation of the valve system and overall engine performance. The prior processes did not measure or take into account the many mechanical variations and tolerances present in different engines of the same type much less the mechanical variations that occur between individual valve assemblies in a single engine.

Thus there is need for a process that improves on the many shortcomings and disadvantages of prior valve lash setting processes which is fast enough for high volume production facilities, is economic, easy to implement and use, and is repeatable.

BRIEF DESCRIPTION OF THE DRAWINGS

The description herein makes reference to the accompanying drawings wherein like reference numerals refer to like parts throughout the several views, and wherein:

FIG. 1 is a side view of a twin-valve arrangement of a first example of an engine which the method described herein can be performed on;

FIG. 2 is a side view of a single-valve arrangement of a second example of an engine which the method described herein can be performed on;

FIG. 4 is a schematic chart showing steps 1-4 of an exemplary process for a valve lash setting;

FIG. 5 is a schematic chart showing sequential steps 5-7 of the exemplary process shown in FIG. 4;

FIG. 6 is a schematic chart showing sequential steps 8-10 of the exemplary process shown in FIGS. 4 and 5;

DETAILED DESCRIPTION

Figure 1:
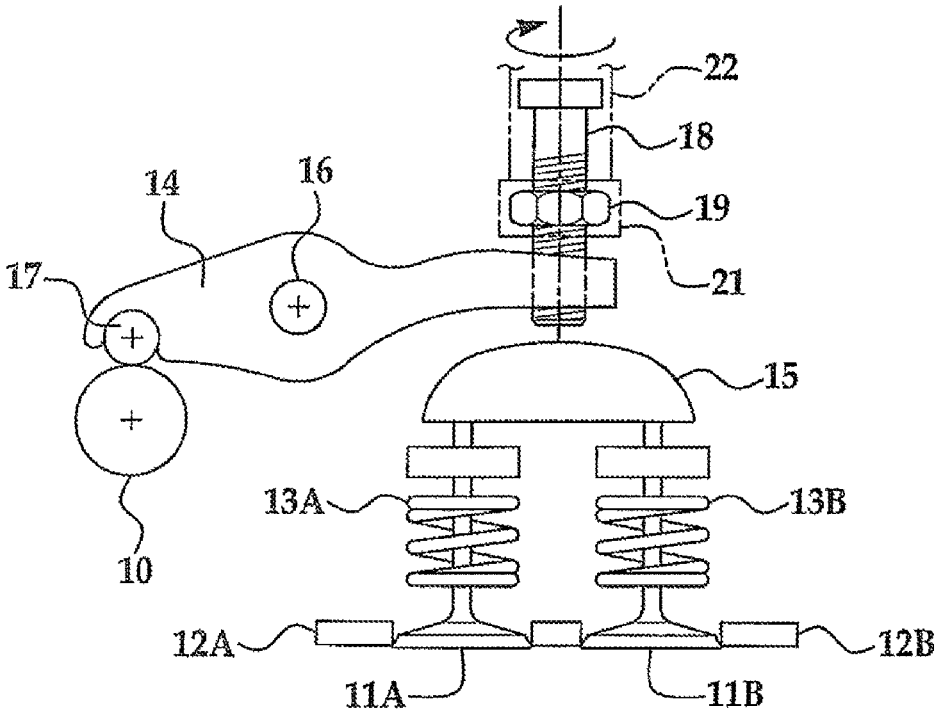
FIG. 1 PRIOR ART

Examples of a valve lash setting process and a torque device usable therewith are described and illustrated in FIGS. 1-12. Examples of the valve lash setting process described herein can be used on various types of engines. One example of an engine that the process can be used on, and described herein for illustrative purposes, is a diesel engine having a twin-valve arrangement that includes two inlet valves and two exhaust valves for each cylinder. FIG. 1 shows one such pair of valves 11*a* and 11*b* of the exemplary diesel engine that can be operated by a cam 10 of an over-head camshaft. The valves 11*a* and 11*b* can be biased toward valve seats 12*a* and 12*b* by springs 13*a* and 13*b* in response to rotation of the cam 10 via a mechanism including a rocker 14 and a yoke 15. The rocker 14 can be pivotally mounted on a spindle 16. The rocker 14 can include a cam follower 17, as well as an adjuster screw 18 and a lock nut 19 at an end opposite the cam follower 17. The adjuster screw 18 can be threaded into the rocker 14 and arranged to transfer a valve opening force from the rocker 14 to the valves 11*a* and 11*b* by abutting against the yoke 15. The adjuster screw 18 can be rotated as shown in FIG. 1 to alter a length that the adjuster screw 18 axially projects from the rocker 14 in a direction toward the yoke 15. The lock nut 19 is threaded onto the adjuster screw 18 prior to threading the screw into the rocker arm 14. The lock nut 19 can be rotated as shown in FIG. 1 to tighten against the rocker 14 thereby rotationally locking the adjuster screw 18 and securing the axial position of the adjuster screw 18 with respect to the rocker 14.

When used in reference to valves 11*a* and 11*b*, the term "valve lash" can refer to the total lash or mechanical "play" in the valve operating mechanism including the cam 10, cam follower 17, adjuster screw 18 and yoke 15. The valve lash can be an aggregate of a lash between the cam 10 and the cam follower 17 and a lash between the adjuster screw 18 and the yoke 15. Since the rocker 14 can be freely pivoted on the spindle 16, the total valve lash can be at either end of the rocker 14 or divided between these two contact points.

Figure 2:
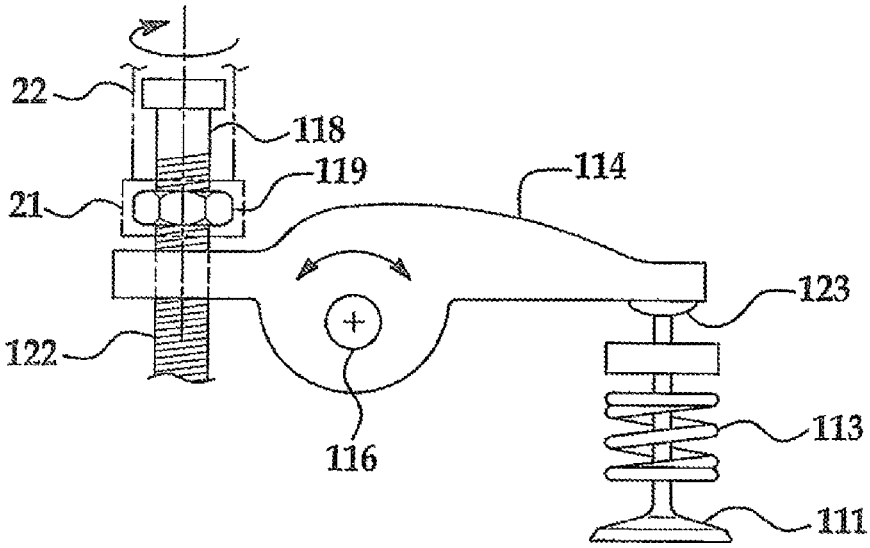
FIG. 2 PRIOR ART

Another example of an engine that the disclosed valve lash setting process can be used on, also describe herein for illustrative purposes, is an internal combustion having a push rod-operated single valve arrangement. FIG. 2 shows a valve 111 of such an engine that can be biased by a spring 113 toward a closed position, a rocker 114 that can be pivotally mounted on a rocker spindle 116, and a push rod 122. One end of the rocker 114 can include a valve engaging head 123, and an opposing end of the rocker 114 can include an adjuster screw 118 that can cooperate with the push rod 122. A lock nut 119 can be threaded onto the adjuster screw 118 for rotatingly and axially arresting the adjuster screw 118 relative to the rocker 114 when the lock nut 119 is tightened.

Figure 3:
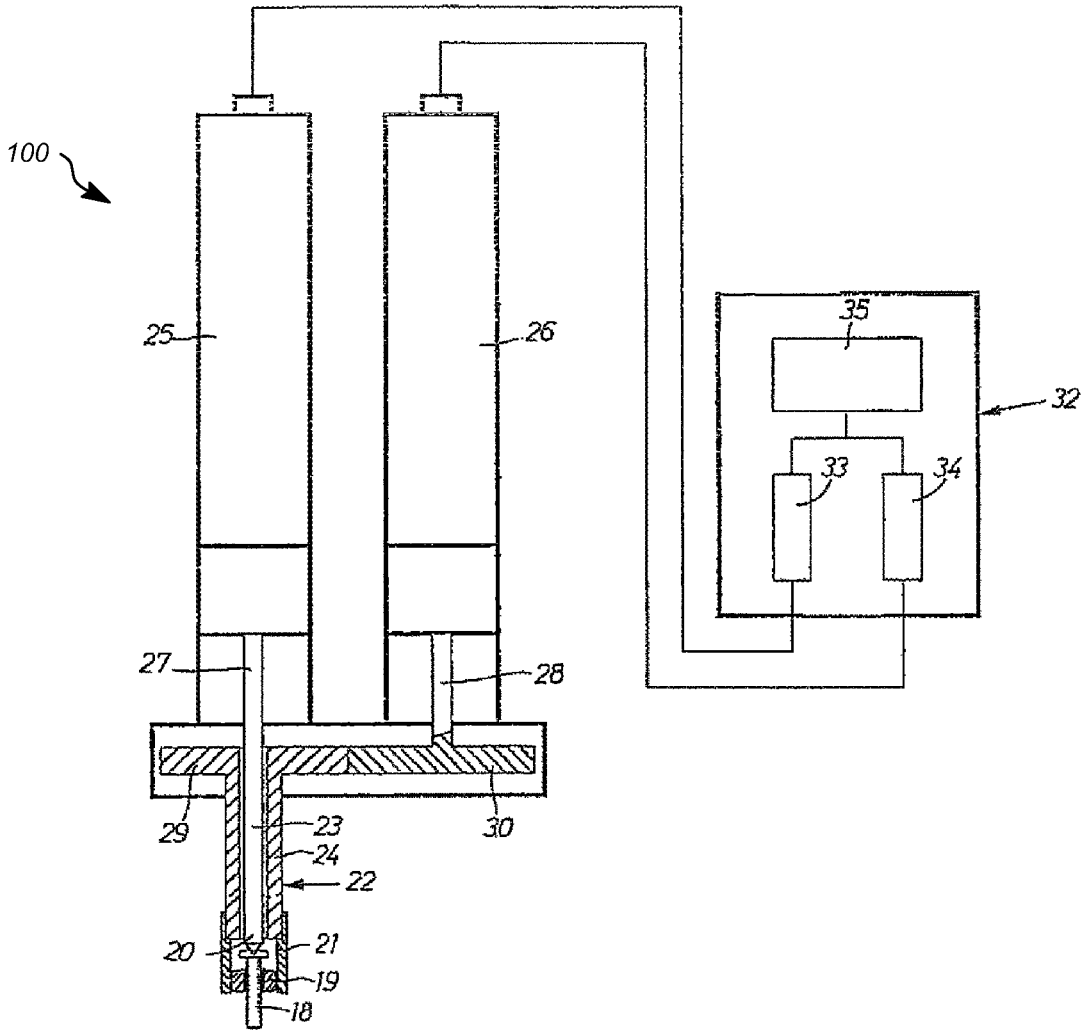
FIG. 3 PRIOR ART
FIG. 3 is a schematic view of a valve lash setting torque device useable in the lash setting process.

The valve lash setting process as described herein can be performed using an exemplary automatic lash setting power torque tool 100 shown in FIG. 3. Other tools having the functions described below may be used as known by those skilled in the art. The tool 100 can be used in combination with the described valve assembly to set the valve lash as described herein on the engines shown in FIG. 1, FIG. 2 and other types of engines known by those skilled in the art. The exemplary tool 100 as shown includes a double spindle 22, although in order examples the tool 100 can include multiple double spindles 22 for setting more than one valve lash at a time. Each spindle 22 includes an inner central spindle 23 and an outer hollow spindle 24 co-axially arranged with and surrounding the inner spindle 23.

The spindles 23 and 24 can be independently rotated by two motors 25 and 26, such as electric motors, via drive lines 27 and 28 including reduction gearings 29 and 30, respectively. The two motors 25 and 26 can be controlled to selectively rotate the adjuster screw 18 or 118 and lock nut 19 or 119 via the spindles 23 and 24, respectively. The inner spindle 23 can include a bit 20 configured to engage and rotate the adjuster screw 18 or 118, whereas the outer spindle 24 can include a nut socket 21 configured to engage and rotate the lock nut 19 or 119. Although described as conventional fasteners, adjuster screw 18 and lock nut 19 can take other forms of adjusting and locking devices known by those skilled in the art.

The motors 25 and 26 can each include an angular displacement sensor (not illustrated) or other means for detecting the angular displacement of the individual spindles 23 and 24 and torque transducers (not illustrated) for detecting the torque actually delivered via the spindles 23 and 24. The torque transducers can be disposed on the spindles 23 and 24 or at another location. Also, as an alternative, the motor 26 and its spindle 24 need not include an angular displacement sensor. As yet another alternative, instead of torque transducers in the motors 25 and 26, the actual torque level could be measured as a certain current level in the respective motor drive. The angular displacement sensors and torque transducers can be connected to an operation control unit 32, which can provide feed back based on operation data.

The operation control unit 32 can include two motor drives 33 and 34 and a programmable control device 35. The control unit 32 can be arranged to control the output power of the motor drives 33 and 34 so as to operate the spindle motors 25 and 26, respectively, according to a certain strategy output by a software program that is downloaded, stored and is executable by a microprocessor in the control device 35. One such suitable control unit 32 is the Power MACS marketed by Atlas Copco assignee of the present invention. A suitable, but exemplary, torque tool 100 is available under the QST or QMX platforms for the Power MACS marketed by Atlas Copco, assignee of the present invention.

Figure 7:
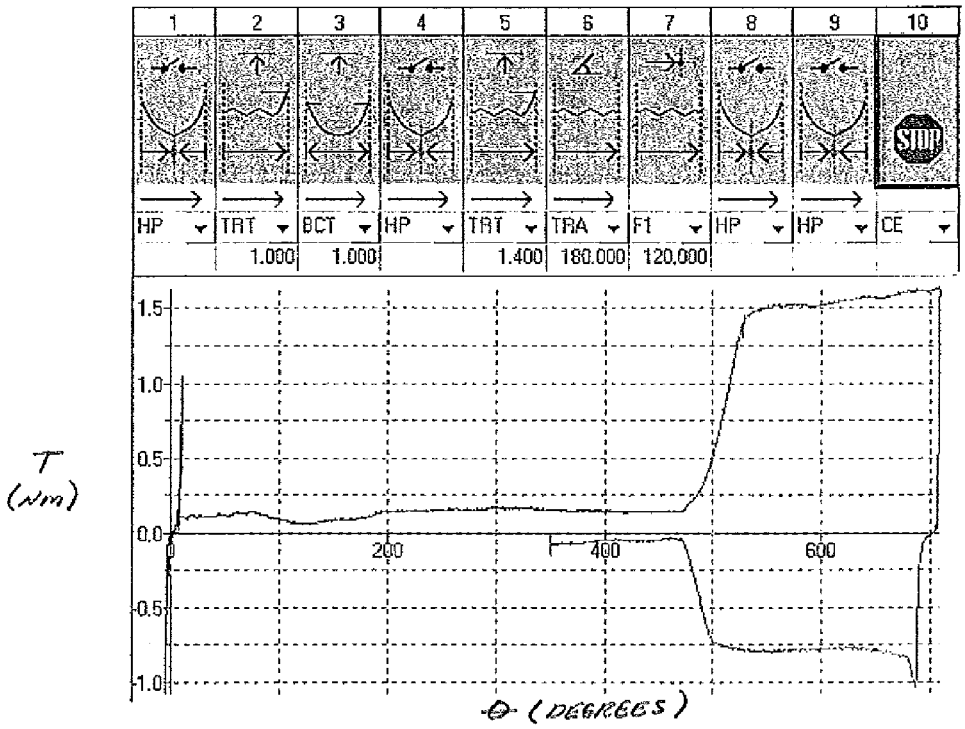
FIG. 7 is a graph of torque versus angular position for a tool bit that adjusts an adjuster screw.
Figure 8:
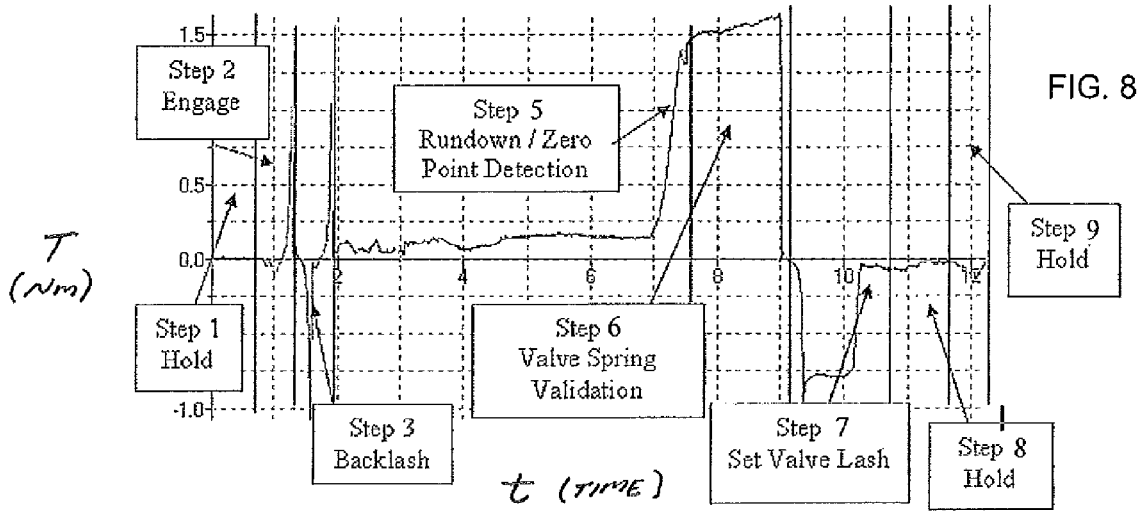
FIG. 8 is a graph of torque versus time for the tool bit that adjusts the adjuster screw.
Figure 9:
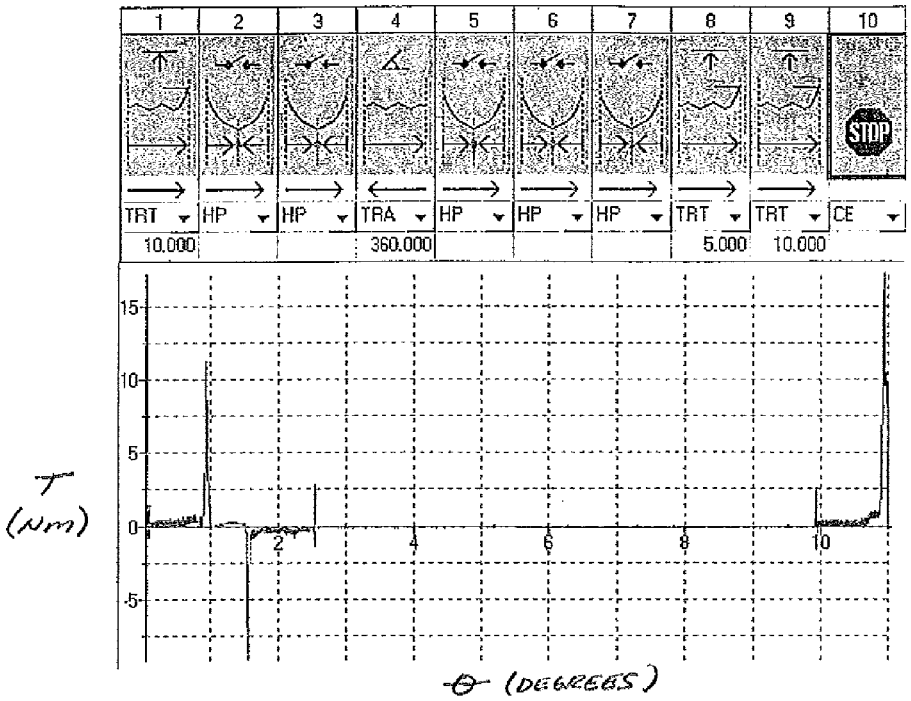
FIG. 9, is a graph of torque versus angular position for a tool bit that adjusts a lock nut.
Figure 10:
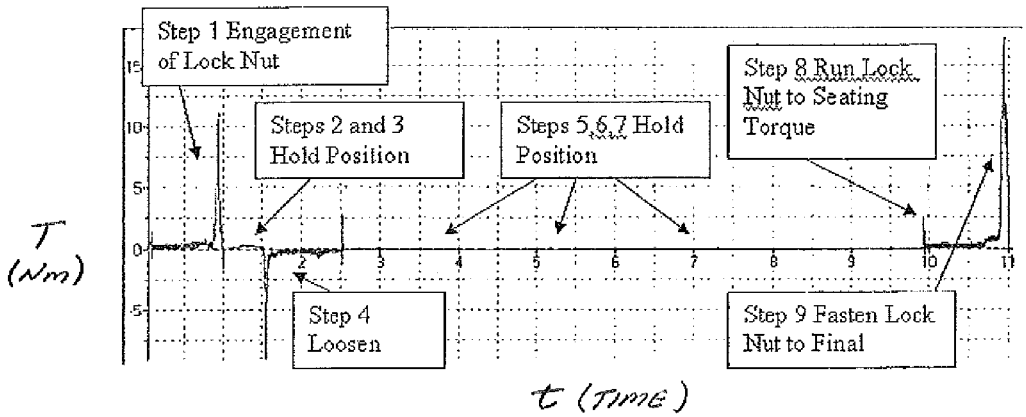
FIG. 10 is a graph of torque versus time for a tool bit that adjusts a lock nut, the time in FIG. 10 corresponding with the time in FIG. 8.

Examples of the valve lash setting process are described herein with reference to the adjuster screw 18 and the lock nut 19 of FIG. 1, although the process can similarly be performed on the adjuster screw 118 and lock nut 119 of FIG. 2 or on another type of engine known by those skilled in the art. The example of the process includes taking measurements and making adjustments to the adjuster screw 18 and lock nut 19 using the tool 100 in a series of operations or steps. The steps are generally described by step in FIGS. 4-6 and graphically in FIGS. 7-10. FIG. 7 illustrates a torque T (Nm) versus angular displacement θ (degrees) curve for the inner spindle 23 of the tool 100 that engages the adjuster screw 18. FIG. 8 illustrates a torque T (Nm) versus time t (variable) curve for the inner spindle 23 labeling the respective steps shown in FIGS. 4-6. FIG. 9 illustrates a torque T (Nm) versus angular displacement θ (degrees) curve for outer spindle 24 of tool 100 that engages lock nut 19. FIG. 10 illustrates a torque T (Nm) versus time t (variable) curve for the outer spindle 24 of the tool 100 that engages the lock nut 19 labeling the respective steps shown in FIGS. 4-6. As the tool 100 spindles 23 and 24 are rotatable independently of one another, the time t in FIG. 8 can correspond with the time t in FIG. 10 as generally described and shown in FIGS. 4-6. The steps could be offset in sequence or other relationship depending on the particular application.

Prior to initiation of the exemplary valve lash setting process described herein, an engine valve assembly including the general engine or valve assembly components illustrated in FIG. 1 or 2, or other engine design needing setting or adjustment of the valve clearance, is presented. In a typical application, adjuster screw 18 is threadably engaged with a corresponding threaded through bore in rocker arm 14. Lock nut 19 is pre-threaded onto adjuster screw 18 with free adjustment of the lock nut 19 in a counterclockwise or clockwise direction.

As best seen in FIG. 3, tool 100 double spindle 22 is brought into proximity with and in surrounding coaxial alignment with adjuster screw 18 and lock nut 19. See FIGS. 1-3, elements 21 and 22 (shown in phantom line in FIGS. 1 and 2). See also FIG. 12, step 300. The applicable and selected software program stored in programmable control device 35 for the particular engine or valve application is recalled from the control device 35 resident memory. Alternately, non-resident or remote programmable or storage devices can send control signals via known communication methods and standards to the programmable control device 35. Manual initiation of the software program and sending of command signals to motor drives 33 and 34 may be employed through push buttons or toggle switches operable by hand. Alternately, automatic initiation of the program once certain safety or assurance checks are made as known by those skilled in the art, may be employed. Combinations of automatic and manual initiation and continuation of method steps may be used as known by those skilled in the art.

Referring to FIGS. 4-6, once the tool 100 is generally in the position with respect to the valve assembly as described above, in a first step or first sequence of commands of the present invention the inner spindle 23 is positionally held or rotatably locked in place with respect to adjuster screw 18 and outer spindle 24. Outer spindle 24 is rotatably driven by motor 26 and gears 29 and 30. Through clockwise rotation of nut socket 21, nut socket 21 positively engages lock nut 19 and threadingly drives it toward rocker 14. Outer spindle 24 tightens the lock nut 19 until a selected and predetermined torque, typically in the range of 5 to 10 Nm, or approximately half a fully tightened torque as specified by an engine manufacturer, is achieved. Other torques to suit the particular application may be used. This step is useful as a process check to confirm that the lock nut 19 is installed on adjuster screw 18 and properly engaged by the nut socket 21 and outer spindle 24.

As best seen in FIGS. 7-10, in the exemplary step 2, the outer spindle 24 is positionally held or rotatably locked in place to hold lock nut 19 in its temporarily secured place. The inner spindle 23 is rotatably driven by motor 25 to apply a small torque to the adjuster screw 18. This low torque rotation of bit 20 serves to positively and rotatably engage bit 20 to the corresponding head of adjuster screw 18, for example a Torx or five-point fastener head. The small torque applied to the adjuster screw 18 can be, as an example, in the range of 1.0 to 2.0 Nm. Applying a small torque to the adjuster screw 18 can confirm that the spindle 23 has engaged the adjuster screw 18 and can indicate that any additional torque output by the spindle 23 will produce rotation of the adjuster screw 18, as opposed to the tool 100 having to rotate the spindle 23 an additional amount before engaging the adjuster screw 18.

Figure 12:
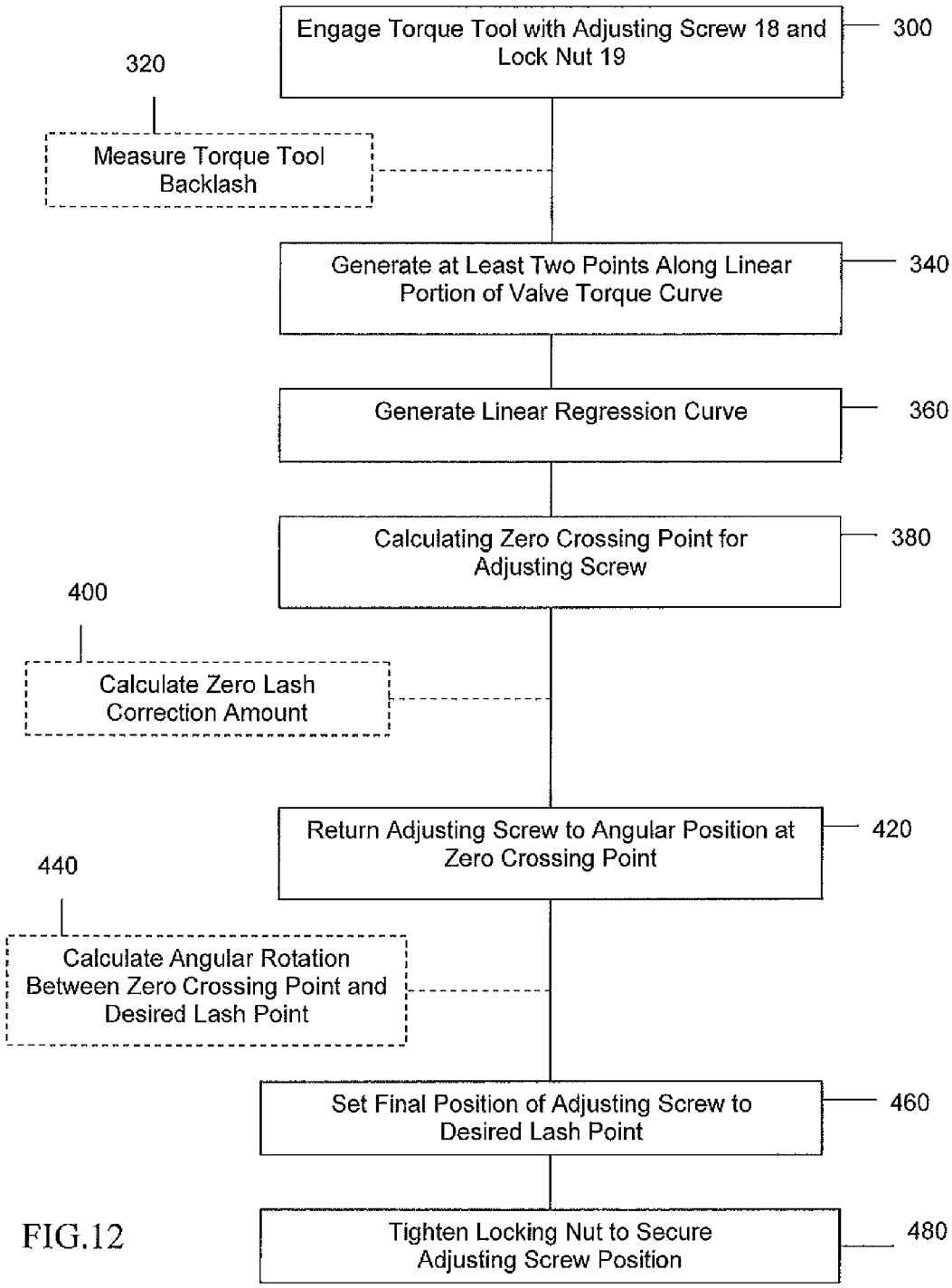
FIG. 12 is a flowchart of an example of process steps for setting valve lash

In exemplary step 3, a tool 100 backlash measurement test and compensation process is performed. This step is useful to measure the backlash or mechanical "play" in the tool 100 drive train and bit 20 in adjuster screw 18 (FIG. 12, step 320). The backlash measurement test can include rotatably holding or locking the outer spindle 24 in place and then first rotatably driving the inner spindle 23 to rotate the adjuster screw 18 in an adjuster screw loosening direction (typically counter-clockwise) until a first predetermined backlash torque, for example 1.0 Nm, is achieved against an arresting force of the tightened lock nut 19, and then to rotate the adjuster screw 18 in an opposite adjuster screw tightening direction (typically clockwise) until a second predetermined backlash torque, for example 1.0 Nm is achieved. It has been determined to be advantageous that lock nut 19 remain tightened as explained in the first step, during performance of the third step.

The backlash measurement test also preferably includes measuring an amount of axial rotation required for the inner spindle 23 to rotate the adjuster screw 18 between achieving the first and second predetermined backlash torques. This measurement can be made using the angular displacement sensor of the tool 100 that measures the angular displacement of the inner spindle 23. The measured spindle 23 rotational amount can be equal to an aggregate of a mechanical lash the tool 100 drivetrain and a mechanical lash created by the engagement of the inner spindle 23, bit 20 and adjuster screw 18, which can hereinafter be referred to as a "tool backlash. Through use of one or more of the above-mentioned sensors, the tool backlash values can be calculated and recorded by the operation control unit 32. Later steps can take the tool backlash into account in accurately setting the valve lash.

In an exemplary fourth step, the inner spindle 23 is rotationally held or locked relative to the adjuster screw 18 and the spindle 24. Outer spindle 24 is rotatably driven by motor 26 as previously described but in an opposite loosening direction to loosen lock nut 19 that was moderately tightened in step 1. In one example, outer spindle 24 can rotate 180 to 360 degrees to loosen the lock nut 19. Outer spindle 24 through nut socket 21 can retain the lock nut 19 in the loosened position. In one example of the valve lash setting process, lock nut 19 is maintained in a loosened, non-torqued state on completion of the fourth step and through the fifth, sixth and seventh steps as described below. As similar to the rotational movement of inner spindle 23, the rotational movement of the outer spindle 24 may be monitored and recorded.

In an exemplary step 5, the inner spindle 23 rotatably and threadingly drives the adjuster screw 18 downward through rocker arm 14 toward the rocker 14 until the distal end of adjuster screw 18 abuttingly contacts the valve spring body assembly, shown in FIG. 1 as yoke 15. On initial abutting contact of the distal end of adjuster screw 18 with yoke 15, shown in FIG. 8 just to the left of time t 7, continued driving of adjuster screw 18 generates a resistance or torque curve 40 having a linear slope portion 44 defining a torque rate as best seen in FIGS. 8 (just to the left of t 7) and 11. This continued driving and torque generated along a linear slope rate continues until a first predetermined torque 200 is achieved, for example 1.4 Nm. The first predetermined torque 200 can be, for example, a specified torque provided by a manufacturer of the engine. Alternatively, the first predetermined torque 200 can be an estimate of the torque required for the rocker 14 to bias the yoke 15 such that the valves 11*a* and 11*b* are biased away from their respective valve seats into an open position. Other specified torques can be used to suit the particular engine or valve type as known by those skilled in the art. During this fifth step, the valve is forcibly moved from a normally biased closed position to an open position.

On achievement of the first predetermined torque 200, a separate monitoring or measuring of the torque T through the torque transducer versus the angular or rotational position of inner spindle 23 through the angular displacement sensor outputs signals for recording and storage in the programmable control device 35. In a preferred example, while the adjuster screw 18 continues to be rotatably driven past the first predetermined torque T, he operation control unit 32 measures, outputs and records several torque versus angular displacement data points along the linear slope portion 44 of the torque curve 40 until a second predetermined torque 202 is achieved as best seen in FIG. 8 (FIG. 12, step 340). In a preferred example, a total of five torque versus angular displacement points can be taken including the first and second predetermined values. It is understood that more or less data points can be measured and recorded. Even if a specific engine has tolerance variances from its specified dimensions, for example, the first and second predetermined torque values will still likely fall on the linear slope portion 44 of the torque curve 40 for that specific engine.

Figure 11:
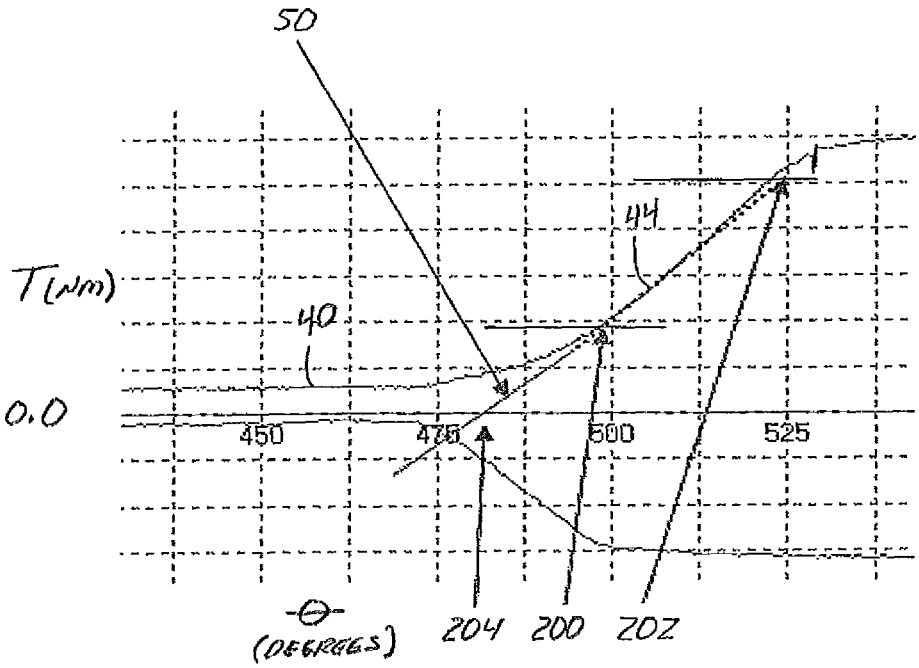
FIG. 11 is a detailed view of a linear portion of the curve of FIG. 8 including a calculated linear regression curve.

The torque T input to the adjuster screw 18 by the spindle 23 and the angular position of inner spindle 23 measured during the fifth step can be used to calculate a linear regression curve 50 as best seen in FIG. 11 (FIG. 12, step 360). That is, if the first and second predetermined torque values 200 and 202 can be used to determine constants m and b in an equation in the form of $Y=mX+b$ where Y is the torque applied to the adjuster screw 18, m is the slope of a linear torque versus angular position curve, and X is the angular position of the spindle 23. The constants m and b may be unique for each engine, and thus the method can be performed on each engine to ensure a high degree of accuracy in the valve lash settings.

As best seen in FIG. 11, the linear regression equation can be used to accurately calculate a zero crossing point 204 where the calculated line crosses the zero (0) (Nm) torque threshold (FIG. 12, step 380). The zero crossing point 204, also commonly known as the zero lash position, is defined as the point where the distal end of adjustment adjuster screw 18 is in axial abutting contact with the valve spring structure, here yoke 15, but no axial load or force is imparted on yoke 15. In a preferred example, as the angular position or displacement of inner spindle 23 has been continually monitored and recorded, the angular position (in degrees) of the adjuster screw 18 for the zero crossing point is known or easily retrieved. The zero crossing point, including the specific angular position of adjuster screw 18 for the zero crossing point, is identified, stored and used as a final position reference point to assist in setting the desired valve lash setting.

In a further example, since the angular position of the inner spindle 23 (and thus adjuster screw 18) has continually been monitored, control unit 32 can calculate and determine the angular displacement required to move the adjuster screw 18 from its position at the end of the fifth step to the zero lash position reference point 204. This angular displacement between the position of the adjuster screw 18 at the end of step 5 and the zero lash position is referred to as a "zero lash correction amount" (FIG. 12, step 400).

Following the determination of the zero lash correction amount, the operation control unit 32 can calculate the angular displacement necessary to return the inner spindle 23 and adjuster screw 18 back to the zero lash reference point 204 for calculation of the final position of the screw to achieve the predetermined valve lash setting or position for the engine. In a preferred example, and for the highest degree of accuracy, the previously determined tool 100 backlash rotational displacement value must be added to the zero lash correction amount to most accurately return the inner spindle 23 back to the zero lash point 204.

In order to achieve the final, predefined and focal valve lash setting linear distance or gap specification, the rotational displacement of the adjuster screw 18 must be calculated to achieve the desired axial linear distance or lash. In a preferred example, the known pitch of the adjuster screw 18 may be used to calculate the necessary rotational displacement needed to achieve the proper final axial position. For example, a typical pitch of the adjuster screw 18 may be 2 mm per 360 degrees, and a typical specified lash may be 0.3 to 0.5 mm for an inlet valve, 0.6 to 0.8 mm for an exhaust valve or 0.8 to 1.2 mm for a Jake Brake. Using the screw pitch and specified lash, the operation control unit 32 can determine how much spindle 23 rotation is required to move the adjuster screw 18 from the zero lash position 204 to the final position at which the valve lash or clearance is at the optimum value or within a predetermined specified range. The amount of rotation required to move the adjuster screw 18 from the zero lash position 204 to the final clearance or gap position is referred to as a "back-out amount."

In a sixth step as best seen in FIGS. 8 and 11, inner spindle 23 may be further rotated beyond the second predetermined torque 202, such as an additional 180 degrees, in order to check and/or confirm rates of the springs 13*a* and/or 13*b*, among other objectives. As an example of another objective that can be achieved by continuing to rotate the adjuster screw 18, if a torque spike is measured by the torque transducer of the spindle 23, it may be the case that a crank of the engine is in the wrong position for performing the process, or it may be the case that the one of the valve springs 13*a* or 13*b* is defective. In a preferred aspect, the additional angular displacement of inner spindle 23 is monitored and recorded.

In an exemplary seventh step the final position of adjustment screw at the desired valve lash or clearance position is set. First, the inner spindle 23, and thus adjuster screw 18 are returned to the calculated zero crossing point or zero lash point 204 from the positional point that the spindle 23 and adjuster screw 18 are at the end of step 6 or the last step employed in the process (FIG. 12, step 420). As noted above, in a preferred example, the positional or rotational/angular difference between the spindle's present position and the zero crossing point/zero lashing point position of the adjuster screw 18 is calculated (FIG. 12, step 440). If the above sixth step is used, the required movement is the aggregate of the angular movement imparted to the adjuster screw 18 in step 6 and the zero lash correction amount. As noted above, in a most preferred method, the tool 100 backlash angular displacement measured in step 3 is considered and added to the zero lash correction amount.

Once the inner spindle 23 and adjuster screw 18 are returned to the reference or zero lash point 204, the previously determined back-out angular rotation needed to achieve the final valve lash setting is employed to drive inner spindle 23. Following execution of these steps, the adjuster screw 18 is at the final desired or specified final position (FIG. 12, step 460).

Referring to FIG. 6, in an eighth step, the inner spindle 23 is postionally held or rotatably locked to hold the adjuster screw 18 stationary while the outer spindle 24 is rotatably driven by motor 25 to first partially tighten the lock nut 19 to, for example, 5 to 10 Nm to ensure that the lock nut 19 is seated and then, in a ninth step, tighten lock nut 19 to its fully tightened torque as specified by the engine manufacturer (FIG. 12, step 480). Holding the adjuster screw 18 stationary can ensure that the adjuster screw 18 does not move from its final position, and thus the lash unintentionally changed, while tightening the lock nut 19. It is understood that a greater or lesser number of steps or stages to finally tighten or torque the lock nut 19 to its specified torque may be employed.

The process can include additional steps. For example, before or after the third step, a series of burnishes can be performed by repeatedly rotating the inner spindle 23 to screw-in and screw-out the adjuster screw 18 to remove spurs or other irregularities in the interface between the adjuster screw 18 and the rocker 14. Also, the process can include fewer steps to suit the particular application or performance specification as known by those skilled in the art. For example, while it can provide benefits and is preferred, the sixth step need not be performed. Likewise, other process checking steps may be eliminated without deviating from the invention.

Additionally, the process contemplates that the operation control unit 32 can control the spindles 23 and 24 to operate at variable speeds. For example, the operation control unit 32 can control the spindles 23 and 24 to operate a high speeds when highly angularly displaced from certain conditions (e.g., predetermined torques and/or calculated angular displacement values) and a lower speeds as the spindles 23 and 24 approach certain torques and/or angular displacements.

Conventionally, determining the zero lash position of a valve has been problematic due to, as examples, bad measurements using feeler gauges or variances in engines from engine specifications when basing the zero lash position on experimental data. One advantage of the above described process is that a zero lash point can be determined for each and every engine. Once the zero lash point is determined, the final lash value specified by the engine manufacturer can easily be obtained. Thus, even if engines of the same type that are supposed to be manufactured to identical specifications in fact have some variances, the above described process can accurately calculate and set the proper valve lash for every engine even when the engines have variances.

The present method has significant advantages over prior designs. One of the most advantageous features is use of the linear regression step to calculate the zero crossing point, which prior processes which required generation of an empirical datum point developed through a series of tests based on an average. The present invention zero crossing point is derived from the linear regression method that defines the zero crossing point from the slope of the vale compliance torque signature. The regression is interpolated through the zero crossing and this point is set to home position for the system from which the final position of adjustment screw is based off of. The method allows each individual valve to be set based on its own torque characteristics and thus removes the inherent error in prior art methods which used empirically derived average based sets.

Further, the above method when used with exemplary tool 100 can significantly reduce the cycle time to set the valve lash. Through experimentation, it has been determined that a preferred time to initiate, execute and complete all of the steps 1-8 in FIGS. 4-6 and described above can be completed in 7-9 seconds. Experimentation has further shown that the time to complete steps 1-8 can be as fast as about 2 seconds although the rapid and abrupt movements of the various mechanical components of tool 100 and the engine components may not be desired. When the tool 100 is suspended and provided with weight and movement assist devices, it provides a fast, convenient and safe method to set the valve lash over prior labor intensive designs which used screw driver hand tools and feeler gages to measure and set the valve lash with much less accuracy and precision than the present invention.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed:

1. A method of setting valve lash for use on an internal combustion engine valve assembly having a rocker arm, a spring body, an adjuster fastener engaged with the rocker arm, and a locking fastener, the method comprising the steps of:

engaging the adjuster fastener and locking fastener with a displacement tool;

linearly displacing the adjuster fastener into contact with the spring body and generating a resistance curve based on an amount of force applied to the adjuster fastener by the displacement tool;

calculating, using the resistance curve, a zero crossing point position of the adjuster fastener with respect to the spring body;

calculating an adjuster fastener predetermined axial final valve lash position with respect to the zero crossing point;

linearly displacing the adjuster fastener away from the spring body to the adjuster fastener predetermined axial final valve lash position; and securing the locking fastener to affix an axial position of the adjuster fastener with respect to the rocker arm.

2. The method of claim 1 wherein the step of calculating the zero crossing point further comprises the step of:

calculating a linear regression from the resistance curve.

3. The method of claim 2 wherein the step of calculating a linear regression further comprises the steps of:

recording at least two values along a substantially linear portion of the resistance curve; and calculating a Y-intercept of the linear regression with a zero resistance baseline value to define the zero crossing point.

4. The method of claim 1 wherein the steps of linearly displacing the adjuster fastener further comprise the step of rotatably driving the adjuster fastener about an axis of rotation with a torque tool.

5. The method of claim 1 wherein the step of calculating the adjuster fastener predetermined axial final valve lash position further comprises the step of calculating a corresponding angular rotational displacement of the adjuster fastener between the zero crossing point and predetermined axial final lash position.

6. The method of claim 5 wherein the step of calculating the corresponding angular rotational displacement of the adjuster fastener further comprises the step of identifying a thread pitch of the adjuster fastener.

7. The method of claim 1 further comprises step of:

measuring backlash of the displacement tool with respect to the adjuster fastener.

8. The method of claim 1 wherein the step of tightening the locking fastener further comprises steps of:

positionally locking the adjuster fastener in place; and independently securing the locking fastener against the rocker arm preventing axial movement of the adjuster fastener with respect to the rocker arm.

9. A method of setting valve lash for use on an internal combustion engine valve assembly with a rotary torque tool having a first rotating spindle and a second rotating spindle that rotates independent of the first rotating spindle, the valve assembly having a rocker arm, a spring body, a threaded adjuster fastener engaged with the rocker arm, and a locking nut, the method comprising the steps of:

independently engaging the adjuster fastener with the first rotating spindle and the locking nut with the second rotating spindle;

rotating the adjuster fastener about an axis into linear contact with the valve spring body using the first rotating spindle while measuring an amount of torque applied to the adjuster fastener by the first rotating spindle and generating a torque resistance curve based on the amount of torque applied to the adjuster fastener by the first rotating spindle;

recording at least two values along a substantially linear portion of the torque resistance curve;

calculating a linear regression using the two values along the linear portion of the torque resistance curve;

calculating a zero crossing point position of the adjuster fastener with respect to the spring body based on the linear regression;

calculating a predetermined axial final valve lash position relative to the zero crossing point;

rotating the adjuster fastener away from the spring body to the predetermined axial final valve lash position; and rotating the locking nut against the rocker arm to affix an axial position of the adjuster fastener with respect to the rocker arm.

10. The method of claim 9 wherein the step of calculating the zero crossing point further comprises the step of:

calculating a Y-intercept of the linear regression with a zero torque resistance baseline value to define the zero crossing point.

11. The method of claim 9 wherein the step of calculating the predetermined axial final valve lash position relative to the zero crossing point further comprises the steps of:

calculating a present rotational position of the adjuster fastener;

calculating a first rotational displacement between the present rotational position and the zero crossing point; and calculating a second rotational displacement between the zero crossing point and the predetermined axial final valve lash position.

12. The method of claim 11 further comprising the step of identifying a thread pitch of the adjuster fastener to determine an axial linear movement of the adjuster fastener with respect to an angular displacement of the adjuster fastener.

13. The method of claim 9 further comprising the step of: measuring a rotational backlash of the rotary torque tool with respect to the adjuster fastener.

14. The method of claim 13 wherein the step of rotating the adjuster fastener to the predetermined axial final valve lash position further comprises the step of adding the measured backlash of the tool to a calculated rotational displacement between a present rotational position of the adjuster fastener and the zero crossing point.

15. The method of claim 13 further comprising the step of tightening the locking nut against the rocker arm prior to measuring the rotary torque tool backlash preventing axial movement of the adjuster fastener during the backlash measuring step.

16. The method of claim 9 further comprises the step of: forcibly opening the valve assembly valve; and closing the valve assembly valve prior to securing the adjuster fastener at the predetermined axial final valve lash position.

17. The method of claim 9 wherein the step of securing the locking nut to affix the adjuster fastener further comprises the step of:

locking an adjuster fastener angular position and an adjuster fastener axial position with respect to the rocker arm and locking nut prior to rotating the locking nut against the rocker arm to maintain the position of the adjuster fastener at the predetermined axial final valve lash position.

18. A method of setting valve lash for use on an internal combustion engine valve assembly with a rotary torque tool having a first rotating spindle and a second rotating spindle that rotates independent of the first rotating spindle, the valve assembly having a rocker arm, a spring body, a threaded adjuster fastener engaged with the rocker arm, and a locking nut, the method comprising the steps of:

independently engaging the adjuster fastener with the first rotating spindle and the locking nut with the second rotating spindle;

locking an adjuster fastener angular position and an adjuster fastener axial position with the first rotating spindle and rotating the locking nut against the rocker arm to temporarily affix the position of the adjuster fastener with respect to rocker arm;

rotating the first rotating spindle to measure backlash of the rotary torque tool with respect to the adjuster fastener;

rotating the locking nut away from the rocker arm to permit rotation of the adjusting screw with respect to the rocker arm;

rotating the adjuster fastener about an axis into linear contact with the valve spring body using the first rotating spindle while measuring an amount of torque applied to the adjuster fastener by the first rotating spindle using a torque transducer connected to the first rotating spindle and generating a torque resistance curve based on the amount of torque applied to the adjuster fastener by the first rotating spindle;

recording at least two values along a substantially linear portion of the torque resistance curve;

calculating a linear regression using the two values along the substantially linear portion of the torque resistance curve;

calculating a zero crossing point position of the adjuster fastener with respect to the spring body based on the linear regression;

calculating a present rotational position of the adjuster fastener, a first angular displacement between the present rotational position and the zero crossing point position, and a second angular displacement between the zero crossing point position and a predetermined axial final valve lash position of the adjuster fastener;

rotating the adjuster fastener from the present rotational position to the predetermined axial final valve lash position with respect to the spring body;

locking the adjuster fastener axial and rotational position with respect to the rocker arm with the first rotating spindle; and rotating the locking nut against the rocker arm to affix an axial position of the adjuster fastener with respect to the rocker arm.

* * * * *

UNITED STATES PATENT AND TRADEMARK OFFICE

CERTIFICATE OF CORRECTION

PATENT NO. : 8,646,426 B2
APPLICATION NO. : 12/880503
DATED : February 11, 2014
INVENTOR(S) : Mark Allen Finkenbiner It is certified that error appears in the above-identified patent and that said Letters Patent is hereby corrected as shown below:

On the Title Page

Item (73) Assignee, delete "Assemble" and insert --Assembly--.

In the Specification

Column 1, line 45, delete "processes" and insert --process--.
Column 6, line 39, delete "he" and insert --the--.
Column 8, line 36, delete "spurs" and insert --burrs--.
Column 8, line 48, delete "a" and insert --at--.
Column 8, line 51, delete "a" and insert --at--.
Column 9, line 6, delete "vale" and insert --valve--.

Signed and Sealed this
Twenty-second Day of March, 2016

Michelle K. Lee

Michelle K. Lee
*Director of the United States Patent and Trademark Office*